US007063325B1

(12) United States Patent
Smith et al.

(10) Patent No.: US 7,063,325 B1
(45) Date of Patent: Jun. 20, 2006

(54) MEANS AND METHOD FOR PLAYING A CARD-CATCHING GAME

(76) Inventors: Wendy Smith, 1901 Bluff St., Hamburg, IA (US) 51640; Cory J. Smith, 11602 S. 37th St., Bellevue, NE (US) 68123

( * ) Notice: Subject to any disclaimer, the term of this patent is extended or adjusted under 35 U.S.C. 154(b) by 0 days.

(21) Appl. No.: 11/096,578

(22) Filed: Apr. 4, 2005

(51) Int. Cl.
*A63F 71/02* (2006.01)

(52) U.S. Cl. ..... 273/445; 273/446; 273/459

(58) Field of Classification Search ..... 273/317, 273/440, 445–448, 456, 459; 434/258
See application file for complete search history.

(56) References Cited

U.S. PATENT DOCUMENTS

| | | | | |
|---|---|---|---|---|
| 2,129,489 | A | | 9/1938 | Brown |
| 2,661,215 | A | | 12/1953 | Stevens |
| 3,011,279 | A | | 12/1961 | Severson |
| 3,334,424 | A | * | 8/1967 | Pond ..... 273/446 |
| 3,582,075 | A | | 6/1971 | Glass et al. |
| 3,679,208 | A | | 7/1972 | Carrano, Jr. et al. |
| 3,717,347 | A | * | 2/1973 | Hottendorf ..... 273/446 |
| 3,747,589 | A | * | 7/1973 | Harrison et al. ..... 600/557 |
| 3,970,303 | A | * | 7/1976 | Levering ..... 273/446 |
| 3,973,774 | A | | 8/1976 | Breslow et al. |
| 4,073,494 | A | | 2/1978 | McAdams |
| 4,185,828 | A | | 1/1980 | Fernandez |
| 4,538,813 | A | | 9/1985 | Pergeau |
| 4,813,683 | A | | 3/1989 | Ginovsky et al. |
| 5,029,797 | A | | 7/1991 | Levorchick et al. |
| 5,407,212 | A | * | 4/1995 | Dobson ..... 273/446 |
| 5,445,378 | A | | 8/1995 | Cook |

* cited by examiner

*Primary Examiner*—Raleigh W. Chiu
(74) *Attorney, Agent, or Firm*—Donald R. Schoonover

(57) ABSTRACT

A catching game is played by pendently supporting a plurality of playing cards from a device. The device is operated by one of the players to release at least one card. The released card falls under the influence of gravity and the air and falls in an unpredictable trajectory. A player must catch the card before it falls to an underlying surface.

3 Claims, 1 Drawing Sheet

MEANS AND METHOD FOR PLAYING A CARD-CATCHING GAME

BACKGROUND OF THE INVENTION

1. Field of the Invention

The present invention relates to the general art of amusement devices, and to the particular field of tossing and catching games.

2. Description of the Related Art

Many people enjoy games in which an object is tossed and must be caught in order to compete against others playing the game. Accordingly, the game art is replete with games that involved tossing and catching objects. While there are many such games, there is always room for another game, especially if the new game is quite different from other such games. This will provide variety and novelty to the art.

Therefore, there is a need for a tossing and catching game that is different from other such games that are presently available.

It has been found that a planar card or piece of paper when dropped will follow an unusual and unpredictable trajectory. The air resistance as well as gravity and the buoyancy of the item all combine to cause the downward trajectory of such an item to be totally unpredictable. A simple air current may totally change the trajectory.

The inventor has observed that such unpredictability may form the basis of a new and novel catching game.

Therefore, there is a need for a tossing and catching game that takes advantage of the unpredictability of a falling card.

The inventor has also observed that many people enjoy a game to a greater extent if there is some element that they can control, even though the ultimate goal of the game will be subject to unpredictability.

Therefore, there is a need for a tossing and catching game that takes advantage of the unpredictability of a falling card yet a game in which a player may have some degree of control.

PRINCIPAL OBJECTS OF THE INVENTION

It is a main object of the present invention to provide a tossing and catching game that is different from other such games that are presently available.

It is another object of the present invention to provide a tossing and catching game that takes advantage of the unpredictability of a falling card.

It is another object of the present invention to provide a tossing and catching game that takes advantage of the unpredictability of a falling card yet a game in which a player may have some degree of control.

SUMMARY OF THE INVENTION

These, and other, objects are achieved by a means and a method for playing a catching game which is played by pendently supporting a plurality of playing cards from a device. The device is operated by one of the players to release at least one card. The released card falls under the influence of gravity and air resistance and falls in an unpredictable trajectory. A player must catch the card before it falls to an underlying surface.

Using the game embodying the present invention will permit a player to exert some control over when a card is released, but the ultimate catching of the card will be subject to the vagaries of the card falling thereby providing a great deal of enjoyment to the game. The inventor is not aware of any game that is similar to the present game and thus the game will be quite novel to the art.

BRIEF DESCRIPTION OF THE DRAWING FIGURES

DETAILED DESCRIPTION OF THE PREFERRED EMBODIMENT

Figures 1, 2:
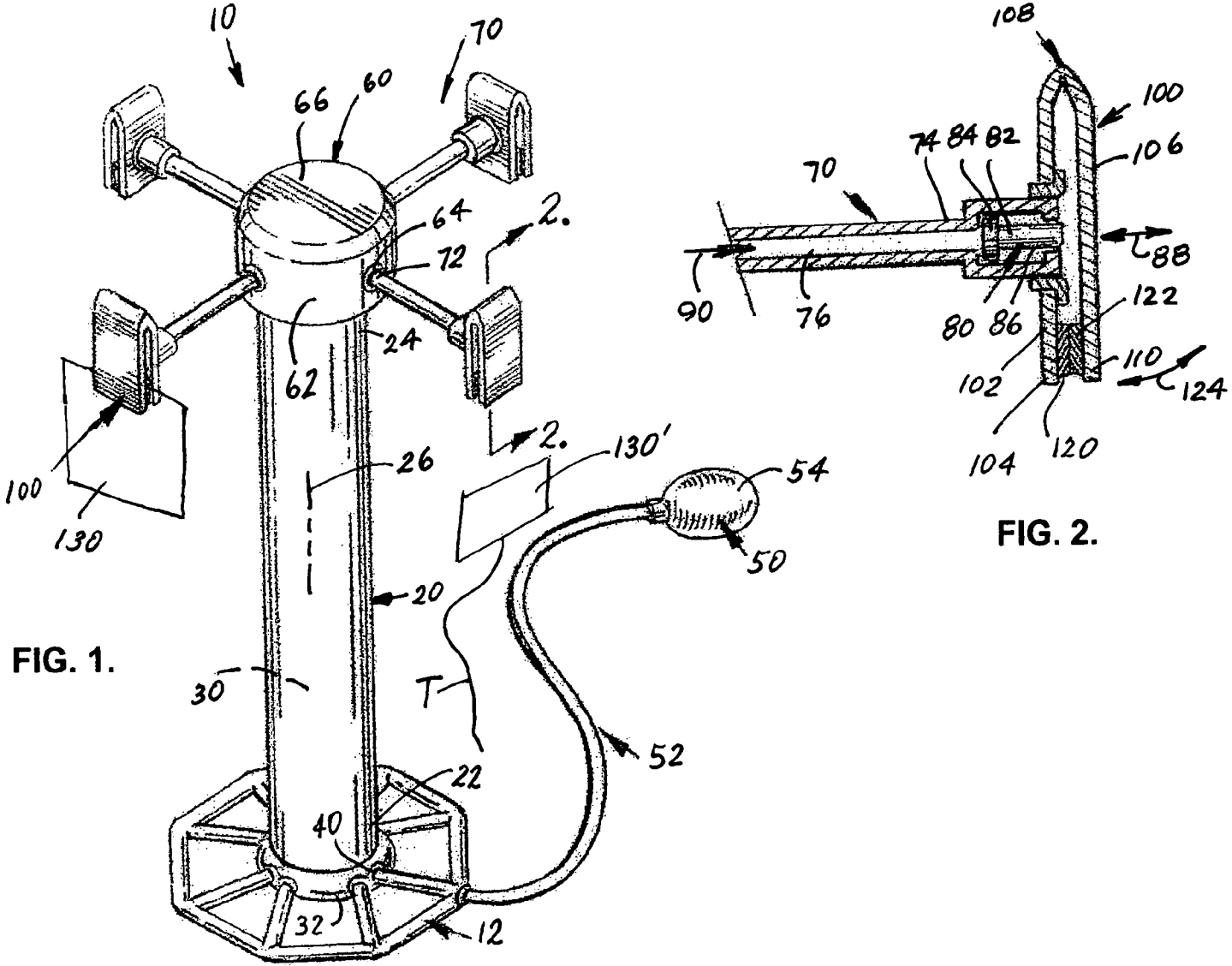
FIG. 1 is a perspective view of a device used in the game embodying the present invention.
FIG. 2 is an elevational view taken along line 2—2 of FIG. 1.

Other objects, features and advantages of the invention will become apparent from a consideration of the following detailed description and the accompanying drawings.

Referring to the Figures, it can be understood that the present invention is embodied in a means and method for playing a game.

The means used in playing the game includes a device 10. Device 10 comprises a base element 12 which is adapted to be supported on a surface 14 such as the ground or a table or the like.

A pedestal element 20 is supported on base element 12 to be in an upright orientation with respect to the surface 14. Pedestal element 20 has a first end 22 which is a bottom end when pedestal element 20 is in use, a second end 24 which is a top end when pedestal element 20 is in use, and a longitudinal axis 26 which extends between first end 22 and second end 24.

Pedestal element 20 is hollow and has a bore 30 defined therethrough from first end 22 to second end 24. A closure cap 32 is located on first end 22 and which fluidically seals the first end 22.

An air inlet port 40 is defined in pedestal element 20 and is fluidically connected to bore 30.

An air source element 50, such as a hand pump or the like, is fluidically connected to air inlet port 40, such as by a fluid line 52 or the like, and includes a manually operated control element, such as squeeze bulb 54, which controls the amount and timing of air flow into bore 30 in pedestal element 20. A fluid source such as an electric pump having an activating switch can also be used if suitable.

A cap unit 60 is located on second end 24 of pedestal element 20 and includes a skirt element 62 which is sized and positioned to encircle the pedestal element 20 adjacent to second end 24 of the pedestal element 20. The skirt element 62 has a plurality of air outlet passages, such as passage 64, defined therethrough. Each air outlet passage 64 is fluidically connected to bore 30 defined in pedestal element 20 so that air flowing through bore 30 can flow out of the air outlet passages 64 defined through the skirt element 62.

A planar top element 66 is unitary with skirt element 62 and is sized and shaped and adapted to cover second end 24 of pedestal element 20 in a fluid tight manner so bore 30 in the pedestal element is fluid tight and air flowing through air inlet port 40 from the fluid source does not escape from bore 30 except as hereinafter disclosed.

A plurality of card-supporting arm units 70 are mounted on the skirt element 62. Each card-supporting arm unit 70 includes a first end 72, which is unitary with the skirt element 62, and a second end 74, which is spaced apart from the skirt element 62 in a direction that is transverse to longitudinal axis 30 of pedestal element 20.

Each card-supporting arm unit 70 extends horizontally and outwardly from the pedestal element 20.

A fluid bore 76 extends from first end 72 to second end 74 of each card-supporting arm unit 70. Each fluid bore 76 is fluidically connected to bore 30 in pedestal element 20 adjacent to the first end 72 of each card-supporting arm unit 70 via the skirt element air outlet passage 64 associated therewith so that air flowing in bore 30 in the pedestal element 20 can flow into the fluid bore 76 of each card-supporting arm unit 70.

A fluid valve element 80 is located on the second end 74 of each card-supporting arm unit 70. The fluid valve element 80 includes a piston element 82 movably mounted on the card-supporting arm unit 70 and having a head 84 and a body 86. The head 84 of the piston element 82 of the valve element 80 covers fluid bore 76 in the card-supporting arm unit 70 associated therewith adjacent to the second end 74 of the card-supporting arm unit 70 associated therewith. As indicated by double-headed arrow 88, the piston element 82 is movable toward and away from the skirt element 62 between a first position shown in solid lines in FIG. 2 which has the head 84 of the piston 82 fluidically covering the fluid bore 76 associated therewith and a second position which has the head 84 of the piston 82 uncovering the fluid bore 76 associated therewith. The piston 82 in each card-supporting arm unit is moved from the first position to the second position by air flowing in the fluid bore 76 associated therewith. This fluid flow is indicated in FIG. 2 by arrow 90.

A card holder unit 100 is mounted on the second end 74 of each card-supporting arm unit 70 and includes a first arm 102 fixedly mounted on the second end 74 of the card-supporting unit 70 associated therewith. The first arm has a distal end 104.

A second arm 106 is movably attached to the first arm 102, as by hinge 108 or the like. The second arm 106 has a distal end 110 which is located adjacent to the distal end 104 of the first arm 102.

A first magnet 120 is mounted on the distal end 104 of the first arm 102, and a second magnet 122 is mounted on the distal end 110 of the second arm 106.

The second arm 106 is movable with respect to the first arm 102 to move between a first position shown in FIG. 2 with the first and second magnets 120, 122 spaced closely adjacent to each other, and a second position with the first and second magnets 120, 122 spaced apart from each other to define a gap between the first and second magnets 120, 122 when the second arm 106 is in the second position. Movement of the second arm 106 is indicated in FIG. 2 by double-headed arrow 124.

The second arm 106 of each card holder unit 100 is located with respect to the piston 82 of the fluid valve element 80 associated therewith to be abutted by the body 86 of the piston element 82 and moved against the force of the magnetic attraction between the first and second magnets 120, 122 into the second position of the second arm 106 by the body 86 of the piston element 82 as the piston element 82 moves into the second position thereof. The second arm 106 returns to the first position thereof under the influence of gravity and under the influence of the magnetic attraction between the first and second magnets 120, 122 when air flowing in the fluid bore 76 associated therewith is removed.

A planar playing card 130 is adapted to be held and supported between the first and second magnets 120, 122 of an associated card-supporting arm unit 70 when the second arm 106 of the associated card-supporting arm unit 70 is in the first position thereof and to be freed from the card-supporting arm unit 70 associated therewith when the second arm of the card supporting unit associated therewith is in the second position thereof. A freed card is shown in FIG. 1 as card 130' and falls toward the underlying surface under the influence of gravity and controlled by buoyancy forces of the air to execute an unpredictable trajectory T.

Various game boards can be used in conjunction with the card release device 10. The card release device 10 can be placed on the game board so the card 130 will fall onto the game board if it is not caught. The game board can be divided into sections with points, penalties and the like associated with each section. Thus, for example, the game board can be set up in a "truth or dare" manner or can be set up with points. If a card is not caught and drops into a particular section, the player will have to act accordingly or be penalized or the like as will occur to those skilled in the art. The game can be played by young and old and can be played under all types of conditions, including parties, bars, and the like.

The catching game associated with device 10 is played as follows. Device 10 is set up on a supporting surface, such as a game board or the like, and cards are placed between the magnets of each card-supporting arm unit. One player is selected to catch the cards while another player is selected to release the cards. The releasing player activates the fluid source 50 and at least one of the card-supporting arm units will be moved under the influence of the piston to release a card. The card falls and the second player must catch it before it hits the underlying surface. If a game board is used, the location of the card falling thereon will be used to either score points, detract points, or require further moves by a player.

It is to be understood that while certain forms of the present invention have been illustrated and described herein, it is not to be limited to the specific forms or arrangements of parts as described and shown.

What is claimed and desired to be covered by Letters Patent is:

1. A device used in playing a game comprising:

a) a base element which is adapted to be supported on a surface;

b) a pedestal element supported on said base to be in an upright orientation with respect to the surface and having (1) a first end which is a bottom end when said pedestal element is in use, (2) a second end which is a top end when said pedestal element is in use, (3) a longitudinal axis which extends between the first end and the second end, (4) said pedestal element being hollow and having a bore defined therethrough from the first end to the second end, (5) a closure cap on the first end which fluidically seals the second end, and (6) an air inlet port defined in said pedestal element and which is fluidically connected to the bore;

c) an air source element fluidically connected to the air inlet port and which includes a manually operated control element which controls the amount and timing of air flow into the bore in said pedestal element;

d) a cap unit on the second end of said pedestal element and including (1) a skirt element which is sized and positioned to encircle said pedestal element adjacent to the second end of said pedestal element, the skirt element having a plurality of air outlet passages defined therethrough, each air outlet passage being fluidically connected to the bore defined in said pedestal element so that air flowing through the bore in said pedestal element can flow out of the air outlet passages defined through the skirt element, (2) a planar top element which is unitary with the skirt element and which is sized and shaped and adapted to cover the second end of said pedestal element in a fluid tight manner so the bore in said pedestal element is fluid tight and air flowing through the air inlet port from said fluid source does not escape from the bore of said pedestal element, (3) a plurality of card-supporting arm units mounted on the skirt element, each card-supporting arm unit including (A) a first end which is unitary with the skirt element, (B) a second end which is spaced apart from the skirt element in a direction that is transverse to the longitudinal axis of said pedestal element, (C) each card-supporting arm unit extending horizontally and outwardly from said pedestal element, (D) a fluid bore which extends from the first end of each card-supporting arm unit to the second end of each card-supporting arm unit, each fluid bore being fluidically connected to the bore in said pedestal element adjacent to the first end of each card-supporting arm via the skirt element air outlet passage associated therewith so that air flowing in the bore in said pedestal element can flow into the fluid bore of each card-supporting arm unit, (E) a fluid valve element on the second end of each card-supporting arm unit, the fluid valve element including a piston element movably mounted on the card-supporting arm unit and having a head and a body, with the head of the piston of the valve element covering the fluid bore in the card-supporting arm unit associated therewith adjacent to the second end of the card-supporting arm unit associated therewith, the piston element being movable toward and away from the skirt element between a first position which has the head of the piston fluidically covering the fluid bore associated therewith and a second position which has the head of the piston uncovering the fluid bore associated therewith, the piston in each card-supporting arm unit being moved from the first position to the second position by air flowing in the fluid bore associated therewith, and (F) a card holder unit mounted on the second end of each card-supporting arm unit and which includes (i) a first arm fixedly mounted on the second end of the card-supporting unit associated therewith, the first arm having a distal end, (ii) a second arm movably attached to the first arm, the second arm having a distal end, (iii) a first magnet mounted on the distal end of the first arm, (iv) a second magnet mounted on the distal end of the second arm, (v) the second arm being movable with respect to the first arm to move between a first position with the first and second magnets closely adjacent to each other and a second position with the first and second magnets spaced apart from each other to define a gap between the first and second magnets when the second arm is in the second position, (vi) the second arm of each card holder unit being located with respect to the piston of the fluid valve element associated therewith to be abutted by the body of the piston element and moved against the force of the magnetic attraction between the first and second magnets into the second position of the second arm by the body of the piston element as the piston element moves into the second position thereof, and (vii) the second arm returning to the first position thereof under the influence of gravity and under the influence of the magnetic attraction between the first and second magnets when air flowing in the fluid bore associated therewith is removed;

e) a planar playing card which is adapted to be held and supported between the first and second magnets of an associated card-supporting unit when the second arm of the associated card-supporting unit is in the first position thereof and to be freed from the card-supporting unit associated therewith when the second arm of the card-supporting unit associated therewith is in the second position thereof.

2. A device used in playing a game comprising:

a) a base;

b) a pedestal element supported on said base to be in an upright orientation with respect to said base, said pedestal element including a fluid bore defined therein;

c) a fluid source fluidically connected to the fluid bore in said pedestal element to force fluid into the fluid bore in said pedestal element;

d) a cap element mounted on said pedestal element and including a plurality of card-supporting arms mounted thereon and extending outwardly therefrom, each card-supporting arm including (1) a fluid bore fluidically connected to the fluid bore defined in said pedestal element to receive fluid therefrom, (2) a fluid valve element which includes a piston movably mounted to move between a fluid bore closing position and a fluid bore uncovering position under the influence of fluid flowing in the fluid bore associated therewith, (3) a card holder unit which includes a first arm fixedly mounted on the card-supporting arm associated therewith and a second arm movably mounted on the card holder associated therewith to move between a card holding position and a card releasing position, (4) a magnet unit on the card holder unit that attracts the second arm toward the first arm and toward the card holding position, and (5) the second arm of each card holder unit being positioned to be contacted by the piston of the card holder unit associated therewith and moved against the influence of gravity and against the influence of the magnet unit away from the first arm and away from the card holding position as the piston of the card holder unit associated therewith moves under the influence of fluid flowing in the fluid bore associated therewith and to move the piston of the card holder unit associated therewith into the fluid bore closing position under the influence of the weight of the second arm and under the influence of the magnetic attraction associated with the magnet unit associated therewith when fluid no longer flows in the fluid bore associated therewith; and e) a planar playing card which is adapted to be held and supported by an associated card-supporting unit when the second arm of the associated card-supporting unit is in the card holding position and to be freed from support when the second arm of the associated card holder unit is moved into the card release position.

3. A method of playing a game comprising:

a) providing a playing card holding device which a base; a pedestal element supported on said base to be in an upright orientation with respect to said base, said pedestal element including a fluid bore defined therein; a fluid source fluidically connected to the fluid bore in said pedestal element to force fluid into the fluid bore in said pedestal element; a cap element mounted on said pedestal element and including a plurality of card-supporting arms mounted thereon and extending outwardly therefrom, each card-supporting arm including a fluid bore fluidically connected to the fluid bore defined in said pedestal element to receive fluid therefrom, a fluid valve element which includes a piston movably mounted to move between a fluid bore closing position and a fluid bore uncovering position under the influence of fluid flowing in the fluid bore associated therewith, a card holder unit which includes a first arm fixedly mounted on the card-supporting arm associated therewith and a second arm movably mounted on the card holder associated therewith to move between a card holding position and a card releasing position, a magnet unit on the card holder unit that attracts the second arm toward the first arm and toward the card holding position, and the second arm of each card holder unit being positioned to be contacted by the piston of the card holder unit associated therewith and moved against the influence of gravity and against the influence of the magnet unit away from the first arm and away from the card holding position as the piston of the card holder unit associated therewith moves under the influence of fluid flowing in the fluid bore associated therewith and to move the piston of the card holder unit associated therewith into the fluid bore closing position under the influence of the weight of the second arm and under the influence of the magnetic attraction associated with the magnet unit associated therewith when fluid no longer flows in the fluid bore associated therewith; and a planar playing card which is adapted to be held and supported by an associated card-supporting unit when the second arm of the associated card-supporting unit is in the card holding position and to be freed from support when the second arm of the associated card holder unit is moved into the card release position;

b) placing a planar playing card in at least one of the card-supporting units;

c) having one player operate and control the fluid source;

d) having at least one of the card control units release the playing card held therein upon activation of the fluid source; and e) a second player trying to catch the released playing card before it reaches the support surface.

* * * * *